US006139909A

United States Patent [19]

Hagewiesche

[11] Patent Number: 6,139,909

[45] **Date of Patent: *Oct. 31, 2000**

[54] USING HYDROCARBON STREAMS TO PREPARE A METALLIC PROTECTIVE LAYER

[75] Inventor: Daniel P. Hagewiesche, Oakland, Calif.

[73] Assignee: Chevron Chemical Company, San Francisco, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/742,282

[22] Filed: Oct. 31, 1996

Related U.S. Application Data

[63] Continuation of application No. 08/475,308, Jun. 7, 1995, abandoned.

[51] Int. Cl.[7] ..... B05D 3/04; B05D 1/36; B05D 7/22

[52] U.S. Cl. ..... 427/142; 427/140; 427/239; 427/248.1; 427/255.26; 427/255.4; 427/335; 427/337; 427/405; 427/419.7

[58] Field of Search ..... 427/230, 239, 427/248.1, 238, 405, 419.7, 335, 140, 142, 255.1, 255.26, 255.4, 337

[56] References Cited

U.S. PATENT DOCUMENTS

| | | | |
|---|---|---|---|
| 2,063,596 | 12/1936 | Feiler | 196/133 |
| 2,263,366 | 11/1941 | Peck et al. | 196/47 |
| 3,890,686 | 6/1975 | Caubet | 29/196 |
| 4,013,487 | 3/1977 | Ramquist et al. | 148/16.5 |
| 4,015,950 | 4/1977 | Galand et al. | 428/638 |
| 4,404,087 | 9/1983 | Reed et al. | 208/48 AA |
| 4,507,196 | 3/1985 | Reed et al. | 208/48 AA |
| 4,511,405 | 4/1985 | Reed et al. | 106/15.05 |
| 5,139,814 | 8/1992 | Sugao | 427/46 |
| 5,208,069 | 5/1993 | Clark et al. | 427/239 |
| 5,405,525 | 4/1995 | Heyse et al. | 208/133 |
| 5,406,014 | 4/1995 | Heyse et al. | 208/134 |
| 5,413,700 | 5/1995 | Heyse et al. | 585/444 |
| 5,575,902 | 11/1996 | Heyse et al. | 208/48 R |
| 5,674,376 | 10/1997 | Heyse et al. | 208/135 |
| 5,676,821 | 10/1997 | Heyse et al. | 208/135 |
| 5,849,969 | 12/1998 | Heyse et al. | 585/483 |
| 5,866,743 | 2/1999 | Heyse et al. | 208/135 |

FOREIGN PATENT DOCUMENTS

| | | |
|---|---|---|
| 1604604 | 12/1981 | United Kingdom . |
| WO92/15653 | 9/1992 | WIPO . |
| WO94/15898 | 7/1994 | WIPO . |

OTHER PUBLICATIONS

King et al., The Production of Ethylene by the Decomposition of n–Butane; the Prevention of Carbon Formation by the Use of Chromium Plating, no date available.

*Primary Examiner*—Shrive Beck
*Assistant Examiner*—Michael Barr
*Attorney, Agent, or Firm*—Pennie & Edmonds LLP

[57] ABSTRACT

A process for producing a metallic protective layer whereby a metal-containing plating, cladding, paint or other coating is applied to at least a portion of a reactor system and then contacted with a gaseous stream containing hydrocarbons, such as impure hydrogen, thereby producing a continuous and adherent metallic protective layer. The gaseous stream preferably comprises hydrogen, which may be recycled. A preferred embodiment of the invention is directed to touch-up procedures where a portion of an already protected reactor system is replaced or rewelded and the protective layer is formed as the replaced portion is brought on-stream.

27 Claims, No Drawings

USING HYDROCARBON STREAMS TO PREPARE A METALLIC PROTECTIVE LAYER

This application is a file-wrapper-continuation of application Ser. No. 08/475,308, filed Jun. 7, 1995, now abandoned.

FIELD OF THE INVENTION

The present invention is a novel process for preparing a metallic protective layer on a substrate such as steel using a hydrocarbon-containing stream, for example using an impure hydrogen stream. The process is especially applicable to touch-up situations where a portion of an already protected reactor system is being replaced or modified. The novel process of this invention can be applied to all or a portion of a reactor system that is used to convert hydrocarbons.

BACKGROUND

It is known to form metallic protective layers on surfaces that are susceptible to carburization, for example on steel surfaces that are used in ultra-low sulfur reforming processes (see WO92/15653) and in other hydrocarbon conversion environments, such as hydrodealkylation (see WO94/15898). These patent applications teach the need for a separate cure step using pure hydrogen to form the metallic protective layer.

Unfortunately, unless there is a hydrogen plant nearby, obtaining pure hydrogen free of hydrocarbons is often difficult, and can be very costly. Moreover, when pure hydrogen is used, it is generally used in a once-thru manner. This is because hydrogen recycle is typically not possible, since most recycle gas compressors cannot handle low molecular weight gases, such as hydrocarbon-free hydrogen. To overcome this recycle problem, the pure hydrogen can be diluted with an inert gas (such as nitrogen). Then compression and recycle become doable. However, nitrogen is also difficult to obtain and costly. In summary, the need for once-thru hydrogen or adding an inert gas significantly adds to the cost of the cure step.

Yet the art for preparing and curing metallic protection layers teaches using a hydrogen stream that is free of hydrocarbons. For example, Heyse et al. in WO 92/15653 teach:

> "The metallic coatings and, in particular, the paints are preferably treated under reducing conditions with hydrogen. Curing is preferably done *in the absence of hydrocarbons*." (page 25, line 23–5, emphasis added.)

An almost identical teaching can be found in Heyse et al. WO 94/15898 on page 23, lines 5–7. Both these patent applications are incorporated herein by reference, especially with regard to useful coating materials and process conditions for curing.

With the known curing process, the start-up procedure, for example, after painting or applying a metal-containing coating to a steel substrate, includes:

1. Heating the reactor system to the cure temperature (typically between 600–1800° F.) in a hydrogen atmosphere;
2. Holding at the cure temperature under hydrogen for up to 3 days;
3. Cooling the reactor system; and only then
4. Beginning standard process start-up procedures.

The new process of this invention eliminates the first three of these steps; it uses "normal", "standard", or only slightly modified start-up procedures—that is, start-up in the presence of feed—to form the metallic protective layer in-situ. It does not require a separate and time-consuming cure step using pure or hydrocarbon-free hydrogen. Thus, the new process reduces start-up times by up to three days and increases on-stream time.

The new process of this invention is especially useful for touch-up situations. For example, it may be used to form a metallic protective layer on a section of a furnace tube that needs replacement. The tube is brought off-line, then cut out and replaced with a new steel section. This section is coated or painted with a metal-containing coating, and then welded in place. As the tube comes on-stream and heats in the presence of hydrocarbon feed, the protective layer is formed in-situ.

SUMMARY OF THE INVENTION

In one embodiment, the present invention is a method of forming a continuous and adherent metallic protective layer on a steel substrate using a gaseous stream that contains substantial amounts of hydrocarbon. The invention is especially useful in touch-up situations where a portion of an already-coated and protected reactor system is replaced or cut open and then resealed.

In one embodiment, the invention is a process for producing a metallic protective layer whereby a metal-containing plating, cladding, paint or other coating is applied to at least one surface of a reactor system. The coated surface is then contacted with a gaseous stream containing hydrocarbons thereby producing the metallic protective layer. The hydrocarbon contacting step occurs before the adherent metallic protective layer is formed or fully cured.

In another embodiment, the invention is applied to a portion of a reactor system used to convert hydrocarbons. Here feed hydrocarbons are converted to desired products in a reactor system of improved resistance to carburization and metal dusting, wherein a metallic carburization-resistant protective layer has been produced on at least a portion of the reactor system, the improvement comprising producing said protective layer by contacting a metal-containing plating, cladding, paint or other coating with a gaseous stream containing hydrocarbons to produce the metallic protective layer.

It is preferred that the hydrocarbon-containing stream also contains hydrogen, that is, the contacting is done in a reducing environment. One preferred hydrocarbon-containing stream is the feed for the hydrocarbon conversion process including feed hydrogen. Another is impure hydrogen.

Among other factors this invention is based on the discovery that, contrary to the teachings of the art, the presence of hydrocarbons during the cure step does not prevent formation of a uninterrupted protective layer. Prior to this invention, it was believed that the presence of hydrocarbons and the interaction of these hydrocarbons with the coated metal or the steel surface would interfere with or adversely impact the formation of a continuous and adherent metallic protective layer.

This invention has significant advantages over other processes. It allows for simpler and less time consuming start-up procedures for the reactor system or a portion thereof, as it eliminates the need for a separate cure step using hydrocarbon-free hydrogen. It also allows for the use of inexpensive impure hydrogen streams or readily available feed streams to produce the protective coating. Additionally, impure hydrogen streams may be used once-thru without significant cost penalties. Thus, the use of hydrocarbon-containing feeds for the cure step lowers the cost of preparing the protective layer. Moreover, the new process significantly simplifies the procedures for forming the protective layer, especially in touch-up situations.

DETAILED DESCRIPTION OF THE INVENTION

In one broad aspect, the present invention is a process which comprises forming a metallic protective layer on a base substrate, such as steel, in the presence of significant amounts of hydrocarbons. In a preferred embodiment, the protective layer is formed by contacting a metal-containing paint, preferably a reducible paint (such as a tin paint) with a stream containing hydrocarbons at temperatures and flow rates effective for converting the paint to a metallic protective layer.

Although the terms "comprises" or "comprising" are used throughout this specification, these terms are intended to encompass both the terms "consisting essentially of", and "consisting of" in various preferred aspects and embodiments of the present invention.

As used herein, the term "reactor system" is intended to include hydrocarbon conversion units that have one or more hydrocarbon conversion reactors, their associated piping, heat exchangers, furnace tubes, etc. Some of the preferred methods of hydrocarbon conversion where this invention is useful utilize catalysts that are sensitive to sulfur.

Here a sulfur converter reactor (for converting organic sulfur compounds to $H_2S$) and a sulfur sorber reactor (for absorbing $H_2S$) may also be present. These are included as part of the reactor systems when present.

As used herein, the term "metal-containing coating" or "coating" is intended to include claddings, platings, paints and other coatings which contain either elemental metals, metal oxides, organometallic compounds, metal alloys, mixtures of these components and the like. The metal(s) or metal compounds are preferably a key component(s) of the coating. Flowable paints that can be sprayed or brushed are a preferred type of coating.

Platings, Claddings, Paints and Other Coatings

Not all metal-containing platings, claddings, paints and other coatings are useful in this invention. Preferred metals are those that interact with, and preferably react with, the base material of the reactor system at temperatures below or at the intended hydrocarbon conversion conditions to produce an adherent metallic protective layer. The preferred metal depends on the hydrocarbon conversion process of interest, its temperatures, reactants, etc. Metals that are mobile or melt below or at the process conditions are especially preferred. These metals include those selected from among tin, antimony, germanium, arsenic, bismuth, aluminum, gallium, indium, copper, lead and mixtures, intermetallic compounds and alloys thereof. Preferred metal-containing coatings are selected from the group consisting of tin, antimony, germanium, arsenic, bismuth, aluminum, and mixtures, intermetallic compounds and alloys thereof. Especially preferred coatings include tin-, antimony- and germanium-containing coatings. These coatings all form continuous and adherent protective layers. Tin coatings are especially preferred—they are easy to apply to steel, are inexpensive and are environmentally benign.

Metal-containing coatings that are less useful include certain metal oxides such as molybdenum oxide, tungsten oxide and chromium oxides. In part this is because it is difficult to form adherent metallic protective layers from these oxides using streams comprising hydrogen and hydrocarbons at most hydrocarbon processing conditions.

It is preferred that the coatings be sufficiently thick that they completely cover the base metallurgy and that the resulting protective layers remain intact over years of operation. This thickness depends on the intended use conditions and the coating metal. For example, tin paints may be applied to a (wet) thickness of between 1 to 6 mils, preferably between about 2 to 4 mils. In general, the thickness after curing is preferably between about 0.1 to 50 mils, more preferably between about 0.5 to 10 mils.

Metal-containing coatings can be applied in a variety of ways, which are well known in the art, such as electroplating, chemical vapor deposition, and sputtering, to name just a few. Preferred methods of applying coatings include painting and plating. Where practical, it is preferred that the coating be applied in a paint-like formulation (hereinafter "paint"). Such a paint can be sprayed, brushed, pigged, etc. on reactor system surfaces.

One preferred protective layer is prepared from a metal-containing paint. Preferably, the paint is a decomposable, reactive, metal-containing paint which produces a reactive metal which interacts with the steel. Tin is a preferred metal and is exemplified herein; dislosures herein about tin are generally applicable to other reducible metals such as germanium. Preferred paints comprise a metal component selected from the group consisting of: a hydrogen decomposable metal compound such as an organometallic compound, finely divided metal and a metal oxide, preferably a reducible metal oxide.

Some preferred coatings are described in WO 92/15653 to Heyse et al. This application also describes preferred paint formulations. One especially preferred tin paint contains at least four components or their functional equivalents: (i) a hydrogen decomposable tin compound, (ii) a solvent system, (iii) finely divided tin metal and (iv) tin oxide. As the hydrogen decomposable tin compound, organometallic compounds such as tin octanoate or neodecanoate are particularly useful. Component (iv), the tin oxide is a porous tin-containing compound which can sponge-up the organometallic tin compound, and can be reduced to metallic tin. The paints preferably contain finely divided solids to minimize settling. Finely divided tin metal, component (iii) above, is also added to insure that metallic tin is available to react with the surface to be coated at as low a temperature as possible. The particle size of the tin is preferably small, for example one to five microns. Tin forms metallic stannides (e.g., iron stannides and nickel/iron stannides) when heated in streams containing hydrogen and hydrocarbons.

In one embodiment, there can be used a tin paint containing stannic oxide, tin metal powder, isopropyl alcohol and 20% Tin Ten-Cem (manufactured by Mooney Chemical Inc., Cleveland, Ohio). Twenty percent Tin Ten-Cem contains 20% tin as stannous octanoate in octanoic acid or stannous neodecanoate in neodecanoic acid. When tin paints are applied at appropriate thicknesses, typical reactor start-up conditions will result in tin migrating to cover small regions (e.g., welds) which were not painted. This will completely coat the base metal. Preferred tin paints form strong adherent protective layers early during the start-up process.

Iron bearing reactive paints are also useful in the present invention. A preferred iron bearing reactive paint will contain various tin compounds to which iron has been added in amounts up to one third Fe/Sn by weight. The addition of iron can, for example, be in the form of $Fe_2O_3$. The addition of iron to a tin containing paint should afford noteworthy advantages; in particular: (i) it should facilitate the reaction of the paint to form iron stannides thereby acting as a flux; (ii) it should dilute the nickel concentration in the stannide layer thereby providing better protection against coking; and (iii) it should result in a paint which affords the anti-coking protection of iron stannides even if the underlying surface does not react well.

Hydrocarbon-Containing Streams

Streams containing hydrocarbons are used to form the protective layer on the metal surfaces of the reactor system. One useful stream is impure hydrogen (e.g., hydrogen containing methane). Impure hydrogen streams are often available in refineries and chemical plants. They typically contain at least 1 volume % hydrocarbons, often 10% or more. Impure hydrogen is a low value stream which is often used as fuel. I have now discovered that these impure streams can be used to prepare an adherent and continuous metallic protective layer. Examples of two such streams are shown in the following table:

| Component | Stream 1 | Stream 2 |
|---|---|---|
| Hydrogen, vol % | 20 | 88 |
| Methane, vol % | 35 | 3 |
| Ethane, vol % | 10 | 3 |
| Other hydrocarbons, vol % | 35 | 6 |

Stream 1 is a typical fluid catalytic cracker (FCC) fuel gas composition. Stream 2 is a typical fuel gas from a catalytic reformer. Although not required, in one preferred embodiment the non-hydrocarbon impurities in the gaseous stream are minimized. For example, $H_2S$, water, and organic sulfur-, oxygen- and nitrogen-containing compounds are removed.

Another stream that can be used to form the protective layer is hydrocarbon feed, including for example recycle hydrogen, such as that used in the process for which the protective layer is needed. The hydrocarbon in this stream is preferably selected from among hydrocarbons including naphthenes, paraffins, aromatics, alkylaromatics, olefins and light gases, including methane. Paraffinic streams are preferred. Hydrocarbon-containing streams may be combined or mixed with other gases such as carbon monoxide, and nitrogen. It is important that the cure stream be selected so that it not damage or attack the protective layer. Therefore, the preferred stream varies with the particular type of metal-containing coating being used. For example, halogen-containing streams are detrimental to some metallic coatings. One especially preferred stream comprises dry hydrocarbon feed or product combined with hydrogen.

An especially preferred steam is a mixture of hydrocarbon and hydrogen containing between about 1 to 90 volume percent hydrocarbon in hydrogen, preferably at least 10 volume percent hydrocarbon in hydrogen, more preferably containing between about 15 and 40 volume percent hydrocarbon. For example, a fixed bed catalytic reformer feed stream is useful. It typically has a hydrogen to hydrocarbon mole ratio of between about 3:1 and 10:1. Although not required, it is preferred to recycle the hydrogen stream, as it significantly reduces costs. With hydrocarbons present in the hydrogen, the recycle gas compressor will operate within design parameters.

Although not currently well understood, it appears that coatings prepared using hydrocarbon-containing streams and/or sulfur compounds produce protective layers that are about 50 percent thicker than those prepared in pure hydrogen. These thicker layers are expected to increase the protection afforded to the base substrate.

Cure Process Conditions

The cure step of this invention contacts a coated steel with a gaseous hydrocarbon-containing stream, such as feed, product, or impure hydrogen at elevated temperatures. Cure conditions depend on the coating metal and are selected so they produce a continuous and uninterrupted protective layer which adheres to the steel substrate. Contacting with the gaseous hydrocarbon-containing stream occurs while the protective layer is being formed. A prior cure step using pure hydrogen is not needed. The resulting protective layer is able to withstand repeated temperature cycling, and does not degrade in the reaction environment. Preferred protective layers are also useful in oxidizing environments, such as those associated with coke burn-off. In a preferred embodiment the cure step produces a metallic protective layer bonded to the steel through an intermediate bonding layer, for example a carbide-rich bonding layer.

Cure conditions depend on the particular metal coating as well as the hydrocarbon conversion process to which the invention is applied. For example, gas flow rates and contacting time depend on the cure temperature, the coating metal and the components of the coating composition. Cure conditions are selected so as to produce an adherent protective layer. In general, the process of this invention contacts the reactor system having a metal-containing coating, plating, cladding, paint or other coating applied to a portion thereof with the hydrocarbon-containing gas for a time and at a temperature sufficient to produce a metallic protective layer. These conditions may be readily determined. For example, coated coupons may be heated in the presence of the hydrocarbon-containing gas in a simple test apparatus; the formation of the protective layer may be determined using petrographic analysis.

It is preferred that cure conditions result in a protective layer that is firmly bonded to the steel. This may be accomplished, for example, by curing the applied coating at elevated temperatures. Metal or metal compounds contained in the paint, plating, cladding or other coating are preferably cured under conditions effective to produce molten or mobile metals and/or compounds. Thus, germanium and antimony paints are preferably cured between 1000° F. and 1400° F. Tin paints are preferably cured between 900° F. and 1100° F. Curing is preferably done over a period of hours, often with temperatures increasing over time. Preferred metallic protective layers, such as those derived from paints, are preferably produced under reducing conditions. Reduction/curing is preferably done at elevated temperatures in the presence of hydrocarbon streams containing hydrogen. The presence of hydrogen is especially advantageous when the paint contains reducible oxides and/or oxygen-containing organometallic compounds.

As an example of a suitable paint cure for a tin paint, the system including painted portions can be pressurized with flowing nitrogen, followed by the addition of a hydrocarbon-containing stream such as a 1:1 hydrogen/naphtha. The reactor inlet temperature can be raised to 800° F. at a rate of 50–100° F./hr. Thereafter the temperature can be raised to a level of 950–975° F. at a rate of 50° F./hr, and held within that range for about 48 hours.

In one embodiment of this invention the metallic protective layer be produced during plant start-up. However, when catalysts are present, it is important that the cure procedures do not result in poisoning of the catalyst or plugging of the catalyst pores. The utility of this process therefore depends in part on the location of, or presence of, a catalyst in the reactor system, and the catalyst's sensitivity towards the coating metal. The process of this invention is preferably applied to furnace tubes, heat exchangers, piping, etc., that are not adjacent to or immediately prior to catalyst beds.

If catalyst poisoning is a concern, provision should be made to prevent stray metal from contacting the catalyst. For example, the curing may be done prior to catalyst loading, or the catalyst may be removed for the curing step. Alternatively, catalyst may be present and a sorber or collector for stray metal, such as a high surface area alumina or silica guard bed, may be used upstream of the catalyst bed. In one embodiment, after the cure step, fresh hydrocarbon conversion catalyst or catalyst removed from the reactors is introduced into the reactor system.

The Base Construction Material

There are a wide variety of base construction materials to which the process of this invention may be applied. In particular, a wide range of steels may be used in the reactor system. In general, steels are chosen so they meet minimum strength and flexibility requirements needed for the intended hydrocarbon conversion process. These requirements in turn depend on process conditions, such as operating temperatures and pressures.

Useful steels include carbon steel; low alloy steels such as 1.25, 2.5, 5, 7, and 9 chrome steel; stainless steels including 316 SS and the 340 stainless steels such as 346; heat resistant steels including HK-40 and HP-50, as well as treated steels such as aluminized or chromized steels. The steel preferably contains iron and chromium in the zero oxidation state.

Depending on the components of the metal-containing coating, reaction of the reactor system metallurgy with the coating can occur. Preferably, the reaction results in an intermediate carbide-rich bonding or "glue" layer that is anchored to the steel and does not readily peel or flake. For example, metallic tin, germanium and antimony (whether applied directly as a cladding or produced in-situ) readily react with steel at elevated temperatures to form a bonding layer as is described in WO 94/15898 or WO 94/15896, both to Heyse et al.

Preferred Applications

The present invention for preparing a metallic protective layer can be utilized to protect one or more large portions of a reactor system, or only a small section thereof. In a preferred embodiment, the present invention is used to touch up relatively small areas of the reactor system that already have a metallic protection layer applied thereto. For example, it may be necessary to replace a portion of the reactor system, due to a failure or a change in process configuration. For example, a section of a furnace tube or reactor screen may need replacement. Here, the furnace tube or section of the tube is isolated or brought off-line. A replacement tube or section is then coated with a metal-containing coating, plating, cladding or paint. The coated tube is then put on-stream in the presence of feed, without a separate cure step. The coating cures in-situ to produce the protective layer.

It is also envisioned that this invention would be especially useful for providing protective layers on new, replacement parts for the reactor internals (such as screens, distributors, associated piping, center pipe and its screens) should they require replacement, and for forming protective layers on transfer piping, flanges and nozzles which are newly constructed or rewelded.

Application to Hydrocarbon Conversion Processes

Reactor systems having metallic protective layers prepared by the novel process of the invention are effective in reducing coking and/or carburization in a variety of hydrocarbon conversion processes. Thus, the novel process of this invention for producing a protective layer can be applied to all or a portion of a reactor system used for converting hydrocarbons.

Preferred hydrocarbon conversion processes include dehydrocyclization of $C_6$ and/or $C_8$ paraffins to aromatics; catalytic reforming; non-oxidative and oxidative dehydrogenation of hydrocarbons to olefins and dienes; dehydrogenation of ethylbenzene to styrene and/or dehydrogenation of isobutane to isobutylene; conversion of light hydrocarbons to aromatics; transalkylation of toluene to benzene and xylenes; hydrodealkylation of alkylaromatics to aromatics; alkylation of aromatics to alkylaromatics; production of fuels and chemicals from syngas ($H_2$ and CO); steam reforming of hydrocarbons to $H_2$ and CO; production of phenylamine from aniline; methanol alkylation of toluene to xylenes; and dehydrogenation of isopropyl alcohol to acetone. Preferred hydrocarbon conversion processes include dehydrocyclization, catalytic reforming, dehydrogenation, isomerization, hydrodealkylation, and conversion of light hydrocarbon to aromatics, e.g. Cyclar-type processing. Preferred embodiments include those where a catalyst, preferably a platinum catalyst, is used to dehydrogenate a paraffin to an olefin, or to dehydrocyclization a paraffinic feed containing $C_6$, and/or $C_8$ hydrocarbons to aromatics (for example, in processes which produce benzene, toluene and/or xylenes).

The present invention is especially applicable to hydrocarbon conversion processes which require catalysts, especially nobel metal catalysts containing Pt, Pd, Rh, Ir, Ru, Os, particularly Pt containing catalysts. These meals are usually provided on a support, for example, on carbon, on a refractory oxide support, such as silica, alumina, chlorided alumina or on a molecular sieve or zeolite. Preferred catalytic processes are those utilizing platinum on alumina, Pt/Sn on alumina and Pt/Re on chlorided alumina; noble metal Group VIII catalysts supported on a zeolite such as Pt, Pt/Sn and Pt/Re on zeolites, including L type zeolites, ZSM-5, SSZ-25, SAPO's, silicalite and beta.

In a preferred embodiment, the invention uses of a medium-pore size or large-pore size zeolite catalyst containing an alkali or alkaline earth metal and charged with one or more Group VIII metals. Especially preferred catalysts for use in this invention are Group VIII metals on large pore zeolites, such as L zeolite catalysts containing Pt, preferably Pt on non-acidic L zeolite. Useful Pt on L zeolite catalysts include those described in U.S. Pat. No. 4,634,518 to Buss and Hughes, in U.S. Pat. No. 5,196,631 to Murakawa et al., in U.S. Pat. No. 4,593,133 to Wortel and in U.S. Pat. No. 4,648,960 to Poeppelmeir et al.

The present invention is especially applicable to hydrocarbon conversion processes that are operated in conjunction with sulfur removal processes or under reduced or low-sulfur conditions using a variety of sulfur-sensitive catalysts. These processes are well known in the art. These processes generally require some feed cleanup, such as hydrotreating and/or sulfur sorption. They include catalytic reforming and/or dehydrocyclization processes, such as those described in U.S. Pat. No. 4,456,527 to Buss et al. and U.S. Pat. No. 3,415,737 to Kluksdahl; catalytic hydrocarbon isomerization processes such as those described in U.S. Pat. No. 5,166,112 to Holtermann; and catalytic hydrogenation/dehydrogenation processes.

In an especially preferred embodiment, the hydrocarbon conversion process is conducted under conditions of "low sulfur". In these low-sulfur systems, the feed will preferably contain less than 50 ppm sulfur, more preferably, less than 20 ppm sulfur and most preferably less than 10 ppm sulfur.

For systems using catalysts that are poisoned by sulfur, it is preferred that hydrocarbon sulfur levels are such that they do not significantly reduce catalyst performance. This level of sulfur depends on the specific catalyst. Generally it is preferred that the sulfur level be very low, i.e., below about 5 ppm, preferably below 1 ppm, and more preferably below 500 ppb. For highly sulfur-sensitive catalysts, sulfur levels should be ultra-low, i.e., below 100 ppb, preferably below 50 ppb, and more preferably below 10 ppb. These substantially sulfur-free gases are preferably also free of oxygen-containing and nitrogen-containing contaminants, such as $NH_3$ or water.

Gases containing sulfur compounds and other contaminants can be treated to remove these contaminants. Those skilled in the art will appreciate that a variety of treatment methods, including hydrotreating, mild reforming and sorption processes, to name a few, are well known for this purpose.

To obtain a more complete understanding of the present invention, the following examples illustrating certain aspects of the invention are set forth. It should be understood, however, that the invention is not intended to be limited in any way to the specific details of the examples.

EXAMPLE 1

This experiment was done in a pilot plant using a ¼" O.D. reactor made of 316 stainless steel. The reactor was coated with a tin-containing paint. The paint consisted of a mixture of 2 parts powdered tin oxide, 2 parts finely powdered tin (1–5 microns), 1 part stannous neodecanoate in neodecanoic acid (20% Tin Tem-Cem) mixed with isopropanol, as described in WO 92/15653. The coating was applied to the inner surface of the tube by filling the tube with paint and letting the paint drain.

After drying, a hydrocarbon-containing stream containing 100 ppmv $H_2S$, 50 vol. % n-hexane and the balance hydrogen was provided at a flow rate of 50 standard cubic centimeters per minute at atmospheric pressure and room temperature. The reactor was then heated to about 1100° F. over 30 hours and held at this temperature for an additional 60 hours with gas flowing. Process gases were used in a once-thru manner.

After this procedure was completed, the reactor was cut open and the resulting layer was examined visually. The steel surface was substantially free of coke. Cross-sections of the steel were mounted in epoxy and polished. They were then examined using petrographic and scanning electron microscopy. The micrographs showed that the tin paint had reduced to metallic tin under these conditions. A continuous and adherent metallic (iron/nickel stannide) protective layer having a thickness of about 30 microns was observed on the steel surface.

EXAMPLE 2

The procedure of Example 1 was repeated using a gas containing 35 volume percent of n-hexane and the balance hydrogen. No sulfur was added. As in Example 1, a continuous and adherent metallic protective layer was produced on the steel surface.

While the invention has been described above in terms of preferred embodiments, it is to be understood that variations and modifications may be used as will be appreciated by those skilled in the art. Indeed, there are many variations and modifications to the above embodiments which will be readily evident to those skilled in the art, and which are to be considered within the scope of the invention as defined by the following claims.

What is claimed is:

1. A touch-up process for a producing a metallic protective layer, comprising, (a) providing a first metallic protective layer to a portion of a reactor system;

(b) reacting hydrocarbons in said reactor system;

(c) applying a metal-containing paint or coating to at least one surface of the reactor system as a touch-up;

(d) thereafter contacting said surface with a gaseous stream containing hydrogen and at least 10 volume percent hydrocarbons, thereby producing a continuous and adherent metallic protective layer.

2. The touch-up process of claim 1 wherein the gaseous stream is fuel gas or impure hydrogen.

3. The touch-up process of claim 1 wherein the metal-containing coating contains a metal selected from the group consisting of tin, antimony, germanium, arsenic, bismuth, aluminum, gallium, indium, copper, lead, and mixtures, intermetallic compounds and alloys thereof.

4. The touch-up process of claim 1 wherein the metal-containing coating contains a metal selected from the group consisting of tin, antimony and germanium.

5. The touch-up process of claim 1 wherein the metal-containing coating comprises a tin paint.

6. The touch-up process of claim 1 wherein the metallic protective layer comprises iron stannide.

7. The touch-up process of claim 1 wherein the gaseous stream contains methane.

8. A method for producing a metallic protective layer on a replacement portion of a reactor system, comprising, replacing an existing portion of a reactor system with a replacement portion;

applying a metal-containing plating, cladding, paint or other coating to said replacement portion; and operating said reactor system using a gaseous stream containing hydrogen and at least 10 volume percent hydrocarbons to cure said metal-containing plating, cladding, paint or other coating and thereby produce a metallic protective layer on said replacement portion.

9. The method of claim 8, wherein said metal-containing plating, cladding, paint or other coating comprises a metal selected from the group consisting of tin, antimony, germanium, arsenic, bismuth, aluminum, gallium, indium, copper, lead, and mixtures, intermetallic compounds and alloys thereof.

10. The method of claim 8, wherein said metal-containing plating, cladding, paint or other coating comprises a metal selected from the group consisting of tin, antimony and germanium.

11. The method of claim 8, wherein said metal-containing plating, cladding, paint or other coating comprises a tin paint.

12. The method of claim 8, wherein said gaseous stream is impure hydrogen or fuel gas.

13. The method of claim 8, wherein said gaseous stream is hydrocarbon feed to said reactor system.

14. The method of claim 13, wherein said hydrocarbon feed is a paraffmic stream.

15. The method of claim 13, wherein said hydrocarbon feed further comprises carbon monoxide.

16. The method of claim 13, wherein said hydrocarbon feed further comprises nitrogen.

17. The method of claim 8, wherein said gaseous stream comprises approximately 15–40 volume percent hydrocarbons.

18. The method of claim 8, wherein said gaseous stream comprises methane.

19. The method of claim 8, wherein said metallic protective layer comprises iron stannide.

20. The method of claim 8, wherein said operating step further comprises the step of operating said reactor system under typical start-up conditions to cure said metal-containing plating, cladding, paint or other coating.

21. The method of claim 8, wherein said operating step further comprises the step of operating said reactor system under typical operating conditions to cure said metal-containing plating, cladding, paint or other coating.

22. The method of claim 8, wherein said replacement portion comprises a portion of a furnance tube.

23. A method for producing a metallic protective layer on a replacement portion of a reactor system, comprising, replacing an first existing portion of a reactor system with a replacement portion, wherein said reactor system has a second existing portion with a previously formed metallic protective layer adjacent to said first existing portion;

applying a metal-containing plating, cladding, paint or other coating to said replacement portion; and operating said reactor system using a gaseous stream containing hydrogen and at least 10 volume percent hydrocarbons to cure said metal-containing plating, cladding, paint or other coating and thereby produce a metallic protective layer on said replacement portion that is contiguous with said previously formed metallic protective layer.

24. A method for producing a metallic protective layer on a replacement portion of a reactor system, comprising, charging a reactor system with a catalyst;

replacing an existing portion of said reactor system with a replacement portion;

applying a metal-containing plating, cladding, paint or other coating to said replacement portion; and operating said reactor system using a gaseous stream containing hydrogen and at least 10 volume percent hydrocarbons to cure said metal-containing plating, cladding, paint or other coating and thereby produce a metallic protective layer on said replacement portion while keeping said catalyst in said reactor system.

25. The method of claim 24, wherein said catalyst is a sulfur-sensitive catalyst.

26. The method of claim 24, wherein said gaseous stream has approximately less than 5 ppm sulfur.

27. The method of claim 26, wherein said gaseous stream has approximately less than 10 ppb sulfur.

* * * * *